US007294018B1

(12) United States Patent
Muro

(10) Patent No.: US 7,294,018 B1
(45) Date of Patent: Nov. 13, 2007

(54) BOARD CONNECTOR

(75) Inventor: Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/740,033

(22) Filed: Apr. 25, 2007

(30) Foreign Application Priority Data

Apr. 25, 2006 (JP) ..... 2006-120664

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS

| | | | | |
|---|---|---|---|---|
| 5,591,050 | A * | 1/1997 | Sueoka | 439/607 |
| 6,203,353 | B1 * | 3/2001 | Huang et al. | 439/607 |
| 6,267,623 | B1 * | 7/2001 | Hisamatsu | 439/607 |
| 6,416,360 | B1 * | 7/2002 | Zhang et al. | 439/607 |
| 6,619,986 | B1 * | 9/2003 | Yeh | 439/607 |

FOREIGN PATENT DOCUMENTS

| | | | |
|---|---|---|---|
| JP | 6-84680 | U | 12/1994 |
| JP | 2005-166491 | A | 6/2005 |
| JP | 2005-294163 | A | 10/2005 |
| JP | 2005-302523 | A | 10/2005 |

* cited by examiner

*Primary Examiner*—Briggitte R. Hammond
(74) *Attorney, Agent, or Firm*—Sughrue Mion, PLLC

(57) ABSTRACT

A board connector according to an embodiment of the invention includes a connector main body 1 that includes a connector housing 10 and terminals and a metal fitting 20 that is press-fitted into the connector housing. The metal fitting is provided with a bottom plate 20A that extends over an entire width of the connector housing in a left-to-right direction. The bottom plate is provided with a pair of first left and right vertical wall-like press-fitting portions 21 that correspond to left and right sides of the connector housing, a pair of second left and right transverse wall-like press-fitting portions 22 that correspond to bottom surfaces of left and right ends of the connector housing, first soldering portions 23 that are located at outer sides of the first and second left and right press-fitting portions in a left-to-right direction, and second soldering portions 24 that are located at inner sides of the first and second left and right press-fitting portions in a left-to-right direction. Further, first press-fitted portions 11 are provided in the left and right sides of the connector housing so as to press-fit the first press-fitting portions of the metal fitting, and second press-fitted portions 22 are provided in the bottom surfaces of the left and right ends of the connector housing so as to press-fit the second press-fitting portions of the metal fitting.

3 Claims, 2 Drawing Sheets

BOARD CONNECTOR

BACKGROUND OF THE INVENTION

1. Field of the Invention

The present invention relates to a board connector that is mounted on a printed circuit board (PCB).

2. Description of the Related Art

In general, a board connector is mounted in a connector housing having a hood portion by inserting terminals into the connector housing. In the board connector, connection ends of the terminals between the terminals and terminals of a counterpart connector protrude to the hood portion, and connection ends of the terminals between the terminals and a printed circuit board are bent in an L shape so as to protrude the connection ends to a side opposite to the hood portion. In this case, the connector housing is used to hold the terminals, maintain a fitting state between the board connector and the counterpart connector, and to fix the board connector to the printed circuit board. Further, the terminals are used to be electrically connected to the terminals of the counterpart connector, to fix the board connector to the printed circuit board by soldering between the terminals and the printed circuit board, and to be electrically connected to a circuit of the printed circuit board.

This type of board connector fixes terminals protruding from a wall surface of the connector housing to the outside to the printed circuit board by means of soldering, but in this case, the support is insufficient. Accordingly, a means for fixing the connector housing to the printed circuit board is generally provided.

As an example of the board connector according to the related art, a board connector shown in FIG. 4 is known (for example, Patent Document 1).

A board connector 100 shown in FIG. 4 has a connector housing 110 and a plurality of terminals 115 that are disposed in the connector housing 110. A metal coating film 120 is provided on a bottom surface of the connector housing 110 and functions as a fixing means for soldering so as to fix the board connector 100 to a printed circuit board (not shown).

The connector housing 110 is formed in substantially a rectangular shape using a synthetic resin, and has its front surface that is provided with a fitting recess 110A into which a counterpart connector is fitted. Each of the terminals 115 is formed of a conductive material, and has one end that is provided with a contact portion 115*a* and the other end that is provided with a soldering portion 115*b*. The contact portion 115*a* is located in the fitting recess of the connector housing and comes into contact with the counterpart connector, and the soldering portion 115*b* protrudes from a rear surface of the connector housing 110 and soldered on the printed circuit board.

In order to mount the board connector 100 having the above-described structure in the printed circuit board, the soldering portions 115*b* of the terminals 115 and the metal coating film 120 overlap pads (not shown) that are formed on the printed circuit board. Then, a reflow process is performed to melt soldering paste (not shown) applied to the pads in advance so as to solder the soldering portions 115*b* of the terminals 115 and the metal coating film 120 to the pads of the printed circuit board.

As such, if the connector housing 110 is directly soldered on the printed circuit board, external force applied to the terminals 115 can be dispersed into the terminals 115 and the connector housing 110. For this reason, it is possible to improve mounting strength of the terminals 115 to the printed circuit board, which achieves secure electrical connection between the terminals 115 and the printed circuit board.

Further, as examples of different types of board connectors, board connectors that are disclosed in Patent Documents 2, 3, and 4 have been known. In these board connectors, L-shaped metal fittings are individually press-fitted into left and right ends of a connector housing that constitutes a connector main body, and each of the metal fittings is soldered on the printed circuit board, such that the connector main body is fixed on the printed circuit board.

Meanwhile, according to a technology disclosed in Patent Document 1 that corresponds to a structure shown in FIG. 4, when a metal coating film 120 is provided on a bottom surface of the connector housing 110 and soldered on the printed circuit board, shearing force is applied to the soldering portions in a board surface direction due to the difference in thermal expansion between the printed circuit board and the connector housing 110, or force is applied to the soldering portion in a film removing direction because of warpage of the printed circuit board due to the thermal change over time, which may cause solder cracks.

Further, according to technologies disclosed in Patent Documents 2, 3, and 4, when the L-shaped metal fittings are individually press-fitted into the left and right ends of the connector housing and are soldered on the printed circuit board, if the length of the board connector in a left-to-right direction is increased, it is not possible to prevent warping of the connector housing. As a result, excessively strong force may be easily applied to a soldering portion of the connector terminal to the printed circuit board or connection portions between the terminals in the board connector.

Patent Document 1:JP-UM-A-6-84680
Patent Document 2:JP-A-2005-166491
Patent Document 3:JP-A-2005-294163
Patent Document 4:JP-A-2005-302523

SUMMARY OF THE INVENTION

The invention has been made to solve the above-described problems, and it is an object of the invention to provide a board connector that is capable of improving mounting strength of the board connector to a printed circuit board and having strong resistance against solder cracks.

In order to achieve the above-described object, according to a first aspect of the invention, a board connector includes a connector main body that includes a connector housing and terminals, the connector housing being fitted into a housing of a counterpart connector, the terminals being held in the connector housing and being electrically connected to terminals of the counterpart connector, and a metal fitting that is press-fitted into the connector housing of the connector main body, and is soldered on a printed circuit board where the metal fitting is mounted so as to fix the connector main body to the printed circuit board. The metal fitting is provided with a bottom plate that extends over an entire width of the connector housing in a left-to-right direction, the bottom plate is provided with a pair of first left and right vertical wall-like press-fitting portions that correspond to left and right sides of the connector housing, a pair of second left and right transverse wall-like press-fitting portions that correspond to bottom surfaces of left and right ends of the connector housing, first soldering portions that are located at outer sides of the first and second left and right press-fitting portions in a left-to-right direction, and second soldering portions that are located at inner sides of the first and second left and right press-fitting portions in a left-to-right direction, and first press-fitted portions are provided in the left and right sides of the connector housing so as to press-fit the first press-fitting portions of the metal fitting, and second press-fitted portions are provided in the bottom surfaces of the left and right ends of the connector housing so as to press-fit the second press-fitting portions of the metal fitting.

According to a second aspect of the invention, in the board connector according to the first aspect of the invention, the metal fitting is formed by bending one metal plate member such that the first and second press-fitting portions are integrated with the first and second soldering portions, and a press-fitting direction of the metal fitting with respect to the connector housing is set to be opposite to a fitting direction of the counterpart connector with respect to the connector main body.

According to a third aspect of the invention, in the board connector according to the first or second aspect of the invention, the first and second soldering portions are provided at positions that are one stage lower than a position at which the metal fitting supports the bottom surface of the connector housing, and that are lower than portions where the second press-fitting 25 portions of the metal fitting are press-fitted into the second press-fitted portions of the connector housing.

In the board connector according to the first aspect of the invention, the first press-fitting portions of the metal fitting are press-fitted into the first press-fitted portions that are provided on both sides of the connector housing, and the second press-fitting portions of the metal fitting are press-fitted into the second press-fitted portions that are provided on the bottom surface of the connector housing, which firmly fixes the metal fitting to the connector main body. In addition, if the first and second soldering portions of the metal fitting are soldered on the printed circuit board, the connector main body can be firmly fixed to the printed circuit board through the metal fitting.

In this state, in the board connector according to the first aspect of the invention, since the left and right sides and the bottom surface of the connector housing can be regulated by the first and second press-fitting portions of the metal fitting, the metal fitting can assuredly suppress the connector housing from deforming due to thermal expansion of the connector housing. For example, if the thermal expansion of the connector housing in the widthwise direction (a horizontal direction that is orthogonal to a fitting direction of the counterpart connector) is suppressed by means of the first press-fitting portions of the metal fitting that are press-fitted into both sides of the connector housing, warpage may occur in the connector housing due to thermal expansion. However, in the board connector according to the first aspect of the invention, the second press-fitting portions of the metal fitting that are press-fitted into the bottom surface of the connector housing prevents the warpage from occurring, and thus, it is possible to prevent the connector housing from thermally deforming. As a result, it is possible to suppress the deformation from affecting positions where the terminals extending from the connector main body are soldered on the printed circuit board. Further, in the board connector according to the first aspect of the invention, the metal fitting is provided with the first soldering portions that are located at the outer sides of the first and second press-fitting portions and the second soldering portions that are located at the inner sides of the first and second press-fitting portions.

As a result, even when deformation occurs between the printed circuit board and the metal fitting due to thermal expansion, the stress can be dispersed.

Accordingly, it is possible to prevent the solder cracks from occurring in the soldering portion of the metal fitting, which improves mounting strength of the board connector to the printed circuit board.

Further, in the board connector according to the second aspect of the invention, since the metal fitting is constructed by bending one metal plate member, the metal fitting can be easily manufactured, and can be easily assembled into the connector main body. Furthermore, since the assembling direction (pressing direction) of the metal fitting to the connector main body is set to a direction opposite to the fitting direction of the counterpart connector, there is no concern in that the press-fitting portions will fall due to the force generated at the time of fitting the board connector. Furthermore, in the board connector according to the third aspect of the invention, the height of the soldering portion of the metal fitting is set to a position that is one stage lower than a position at which the metal fitting supports a bottom surface of the connector housing and the connector main body is supported to float from the printed circuit board. Therefore, it is possible to minimize the stress due to heat.

According to the aspects of the invention, it is possible to provide a board connector that is capable of improving mounting strength of the board connector to the printed circuit board and having strong resistance against solder cracks.

The invention has been described in brief. Further, the preferred embodiment of the invention that will be described below is read with reference to the accompanying drawings and thus the detail of the invention will be obvious.

DESCRIPTION OF THE PREFERRED EMBODIMENTS

Hereinafter, the preferred embodiment of the invention will be described with reference to FIGS. 1 to 3.

Figure 1:
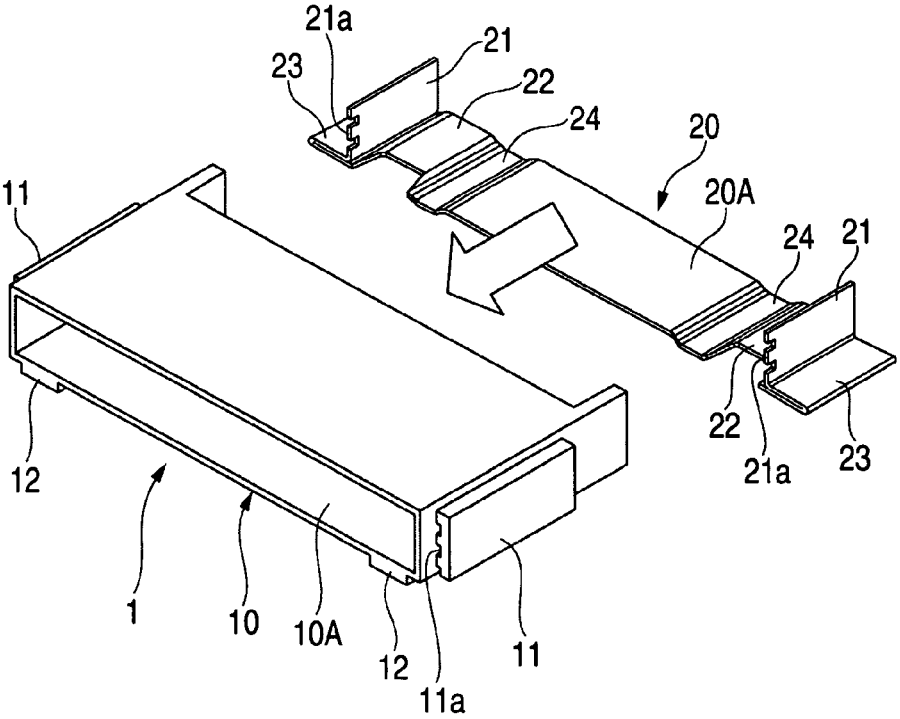
FIG. 1 is a perspective view illustrating a state before assembling a board connector according to an embodiment of the invention, when viewed from an upper side.
Figure 2:
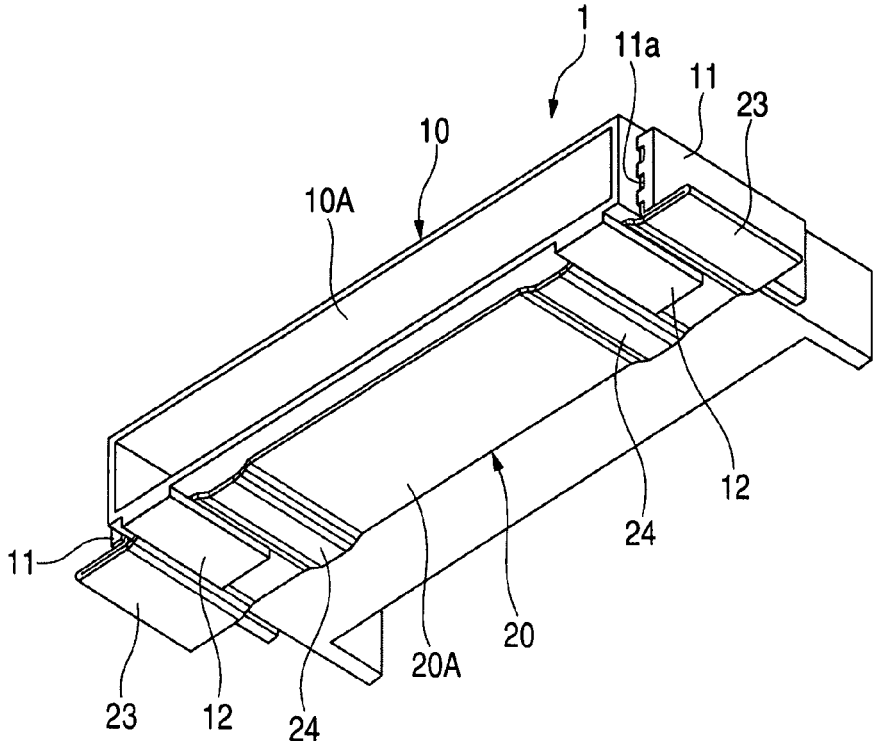
FIG. 2 is a perspective view illustrating a state after assembling the same board connector, when viewed from a lower side.

FIG. 1 is a perspective view illustrating a state before assembling a board connector according to an embodiment of the invention, when viewed from an upper side. FIG. 2 is a perspective view illustrating a state after assembling the same board connector, when viewed from a lower side. FIG. 3 is a partially enlarged view illustrating a state where the same board connector is mounted on a printed circuit board, when viewed from the front.

The board connector includes a connector main body 1 and a metal fitting 20. The connector main body 1 includes a connector housing 10 that is fitted into a housing of a counterpart connector (not shown), and a plurality of terminals (not shown) that are held in the connector housing 10 and are electrically connected to terminals of the counterpart connector.

The connector housing 10 is formed in a laterally long rectangular shape using a synthetic resin. The front surface of the connector housing 10 is provided with a fitting recess 10A into which the counterpart connector is fitted. Each of the terminals (not shown) has one end that is located in the fitting recess 10A of the connector housing 1 and the other end that protrudes from the back of a rear wall surface of the connector housing 10 and is bent in an L shape so as to be soldered on the printed circuit board.

The metal fitting 20 is press-fitted into the connector housing 10 of the connector main body 1. The metal fitting 20 is soldered on the printed circuit board that is a mounting subject, and fixes the connector main body 1 to the printed circuit board. The metal fitting 20 is constructed by bending one metal plate member.

In this case, the metal fitting 20 has a bottom plate 20A that extends over an entire width of the connector housing 10 in a left-to-right direction. The bottom plate 20A is provided with a pair of first left and right vertical wall-like press-fitting portions 21 that correspond to left and right sides of the connector housing 10, a pair of second left and right transverse wall-like press-fitting portions 22 that correspond to bottom surfaces of left and right ends of the connector housing 10, first soldering portions 23 that are located at outer sides of the first left and right press-fitting portions 21 and the second left and right press-fitting portions 22 in a left-to-right direction, and second soldering portions 24 that are located at inner sides of the first left and right press-fitting portions 21 and the second left and right press-fitting portions 22 in a left-to-right direction.

Meanwhile, the connector housing 10 includes first press-fitted portions 11 that are provided at the left and right sides of the connector housing 10 so as to backward press-fit the first press-fitting portions 21 of the metal fitting 20, and second press-fitted portions 12 that are provided on the bottom surfaces of the left and right ends of the connector housing 10 so as to backward press-fit the second press-fitting portions 22 of the metal fitting 20. In this case, the press-fitting direction of the metal fitting 20 with respect to the connector housing 10 is set to be opposite to a fitting direction of the counterpart connector with respect to the connector main body 1. Further, at front end edges of the first press-fitting portions 21, locking protrusions 21*a* are provided, such that the locking protrusions 21*a* are locked into locking grooves 11*a* of the first press-fitted portions 11 at the side of the connector housing 10 so as to regulate movement of the first press-fitting portions 21 with respect to the connector housing 10 in an up-to-down direction.

Further, the first and second soldering portions 23 and 24 of the metal fitting 20 are provided at positions that are one stage lower than a position at which the metal fitting 20 supports a bottom surface of the connector housing 10, and that are lower than portions where the second press-fitting portions 22 of the metal fitting 20 are press-fitted into the second press-fitted portions 12 of the connector housing 10.

When the board connector is mounted in the printed circuit board, first, the first press-fitting portions 21 of the metal fitting 20 are press-fitted into the first press-fitted portions 11 provided on both sides of the connector housing 10 from the rear side of the connector housing 10. At the same time, the second press-fitting portions 22 of the metal fitting 20 are press-fitted into the second press-fitted portions 12 provided on the bottom surface of the connector housing 10 from the rear side of the connector housing 10. In this way, it is possible to firmly fix the metal fitting 20 to the connector main body 1.

Figure 3:
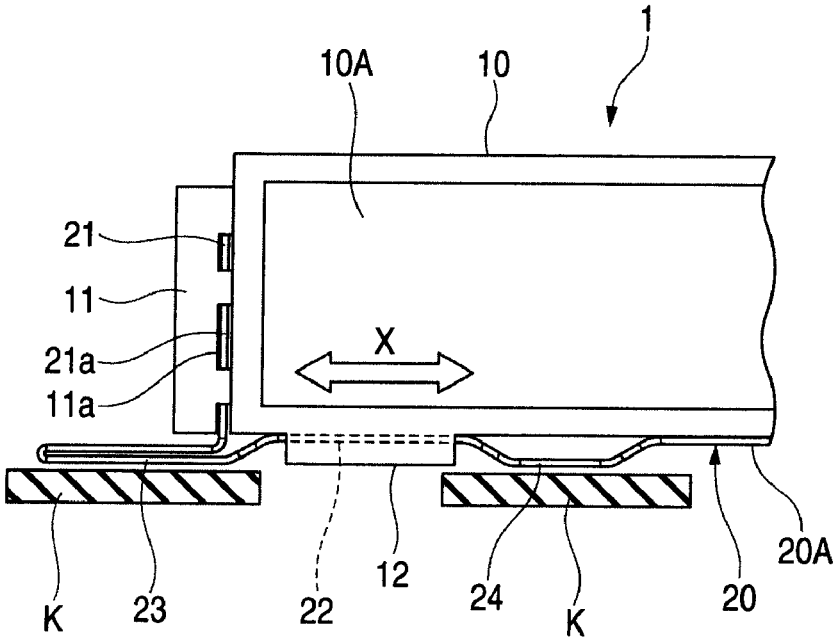
FIG. 3 is a partially enlarged view illustrating a state where the same board connector is mounted on a printed circuit board, when viewed from the front.
Figure 4:
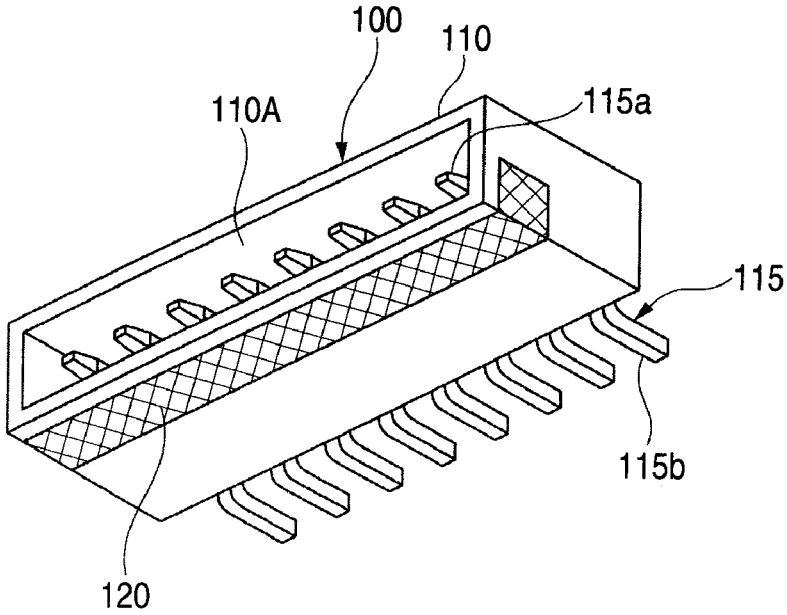
FIG. 4 PRIOR ART
FIG. 4 is a perspective view illustrating a board connector according to the related art, when viewed from a lower side.

In addition, as shown in FIG. 3, the first and second soldering portions 23 and 24 of the metal fitting 20 are soldered on a printed circuit board K, and thus it is possible to firmly fix the connector main body 1 to the printed circuit board K by the metal fitting 20.

In this state, since the left and right sides and the bottom surface of the connector housing 10 can be regulated by the first press-fitting portions 21 and the second press-fitting portions 22 of the metal fitting 20, the metal fitting 20 can assuredly suppress a deformation of the connector housing 10 in a left-to-right direction due to the thermal expansion of the connector housing 10.

For example, if the thermal expansion of the connector housing 10 in the widthwise direction (a horizontal direction X that is orthogonal to a fitting direction of the counterpart connector) is suppressed by means of the first press-fitting portions 21 of the metal fitting 20 that are press-fitted into both sides of the connector housing 10, warpage may occur in the connector housing 10 due to thermal expansion. However, the second press-fitting portions 22 of the metal fitting 20 that are press-fitted into the bottom surface of the connector housing 10 suppresses the warpage, and thus it is possible to prevent the connector housing 10 from thermally deforming. As a result, it is possible to suppress the deformation from affecting positions where the terminals extending from the connector main body 1 are soldered on the printed circuit board K.

Further, the metal fitting 20 is provided with the first soldering portions 23 that are located at the outer sides of the first and second press-fitting portions 21 and 22 and the second soldering portions 24 that are located at the inner sides of the first and second press-fitting portions 21 and 22. As a result, even when deformation occurs between the printed circuit board K and the metal fitting 20 due to thermal expansion, the stress can be dispersed. Accordingly, it is possible to prevent the solder cracks from occurring in the soldering portion of the metal fitting 20, which improves the mounting strength of the board connector to the printed circuit board.

Further, in the board connector according to this embodiment, since the metal fitting 20 is constructed by bending one metal plate member, the metal fitting 20 can be easily manufactured, and can be easily assembled into the connector main body 1. Furthermore, since the assembling direction (press-fitting direction) of the metal fitting 20 to the connector main body 1 is set to a direction opposite to the fitting direction of the counterpart connector, there is no concern in that the press-fitting portions will fall due to the force generated at the time of fitting the board connector. Further, the height of the soldering portion of the metal fitting 20 is set to a position that is one stage lower than a position at which the metal fitting 20 supports a bottom surface of the connector housing 10 such that the connector main body 1 is supported to float from the printed circuit board K. Therefore, it is possible to minimize the stress due to heat.

Further, when the main soldering is not performed by the first soldering portions 23 and the sub-soldering is performed by the second soldering portions 24, the amount of solder in the second soldering portion 24 is set to be smaller than the amount of solder in the first soldering portion 23. In this way, the first soldering portion 23 is responsible for the main mounting strength and the second soldering portion 24 is responsible for the auxiliary mounting strength. This can be achieved by setting the height of the second soldering portion 24 to be slightly larger than the height of the first soldering portion 23.

The invention is not limited to the above-described embodiment, but various changes and modifications and improvements can be made. Further, materials, forms, the number, arrangement positions, and the like of the components in the above-described embodiments are not limited but may be arbitrarily set, so long as the invention can be achieved.

What is claimed is:

1. A board connector, comprising:

a connector main body that includes a connector housing and terminals, the connector housing being fitted into a housing of a counterpart connector, the terminals being held in the connector housing and electrically connected to terminals of the counterpart connector; and a metal fitting that is press-fitted into the connector housing of the connector main body, and is soldered on a printed circuit board that is a mounting subject so as to fix the connector main body to the printed circuit board;

wherein the metal fitting is provided with a bottom plate that extends over an entire width of the connector housing in a left-to-right direction;

the bottom plate is provided with a pair of first left and right vertical wall-like press-fitting portions that correspond to left and right sides of the connector housing, a pair of second left and right transverse wall-like press-fitting portions that correspond to bottom surfaces of left and right ends of the connector housing, first soldering portions that are located at outer sides of the first and second left and right press-fitting portions in a left-to-right direction, and second soldering portions that are located at inner sides of the first and second left and right press-fitting portions in a left-to-right direction, and first press-fitted portions are provided in the left and right sides of the connector housing so as to press-fit the first press-fitting portions of the metal fitting, and second press-fitted portions are provided in the bottom surfaces of the left and right ends of the connector housing so as to press-fit the second press-fitting portions of the metal fitting.

2. The board connector according to claim 1, wherein the metal fitting is formed by bending one metal plate member such that the first and second press-fitting portions are integrated with the first and second soldering portions, and a press-fitting direction of the metal fitting with respect to the connector housing is set to be opposite to a fitting direction of the counterpart connector with respect to the connector main body.

3. The board connector according to claim 1, wherein the first and second soldering portions are provided at positions that are one stage lower than a position at which the metal fitting supports the bottom surface of the connector housing, and that are lower than portions where the second press-fitting portions of the metal fitting are press-fitted into the second press-fitted portions of the connector housing.

* * * * *